US005958147A

United States Patent [19]

Berglind et al.

[11] Patent Number: 5,958,147

[45] Date of Patent: Sep. 28, 1999

[54] METHOD OF TREATING A METAL

[75] Inventors: Troy Berglind, Torslanda; Arne Frestad, Göteborg, both of Sweden

[73] Assignee: Akzo Nobel N.V., Arnhem, Netherlands

[21] Appl. No.: 09/069,205

[22] Filed: Apr. 29, 1998

Related U.S. Application Data

[60] Provisional application No. 60/052,734, Jul. 8, 1997.

[30] Foreign Application Priority Data

May 5, 1997 [SE] Sweden ..... 97850075

[51] Int. Cl.[6] ..... C23G 1/02; C23F 1/00; C09K 13/00; C11D 3/02

[52] U.S. Cl. ..... 134/3; 156/666; 216/108; 510/109

[58] Field of Search ..... 134/3; 156/666; 216/108; 510/109

[56] References Cited

U.S. PATENT DOCUMENTS

| | | | |
|---|---|---|---|
| 2,383,470 | 8/1945 | Morgan | 134/3 |
| 3,945,865 | 3/1976 | Kamperman . | |
| 3,948,703 | 4/1976 | Kushibe | 156/20 |
| 3,953,263 | 4/1976 | Ishikawa et al. . | |
| 4,459,216 | 7/1984 | Nakazato et al. | 252/79.4 |
| 4,510,018 | 4/1985 | McGowan | 156/666 |
| 4,938,838 | 7/1990 | Dalin et al. . | |
| 5,306,431 | 4/1994 | Fischer et al. . | |
| 5,538,152 | 7/1996 | Fontana | 216/108 |
| 5,800,859 | 9/1998 | Price et al. | 427/98 |

FOREIGN PATENT DOCUMENTS

| | | |
|---|---|---|
| 053 719 | 6/1982 | European Pat. Off. . |
| 0 259 533 | 9/1986 | European Pat. Off. . |
| 0 442 250 | 1/1990 | European Pat. Off. . |
| 0 529 332 | 7/1992 | European Pat. Off. . |
| 2 253 103 | 11/1973 | France . |
| 2 279 447 | 7/1975 | France . |
| 124 660 | 3/1977 | German Dem. Rep. . |
| 375599 | 8/1931 | United Kingdom . |

OTHER PUBLICATIONS

Sanders, N.J., "Environmentally friendly stainless steel pickling," Anti–Corrosion Methods and Materials, vol. 44, no. 1, Jan. 1977, pp. 20–25.

*Primary Examiner*—Jill Warden
*Assistant Examiner*—Yolanda E. Wilkins
*Attorney, Agent, or Firm*—McDermott, Will & Emery

[57] ABSTRACT

The invention relates to a method of pickling or surface treating a metal in an aqueous solution containing nitric acid wherein hydrogen peroxide is supplied to decrease the formation of nitrous fumes. At least a portion of the hydrogen peroxide is supplied by spraying or flushing an aqueous solution thereof directly on the metal through one or several separate nozzles (18*a*, 18*b*, 19*a*, 19*b*).

10 Claims, 1 Drawing Sheet

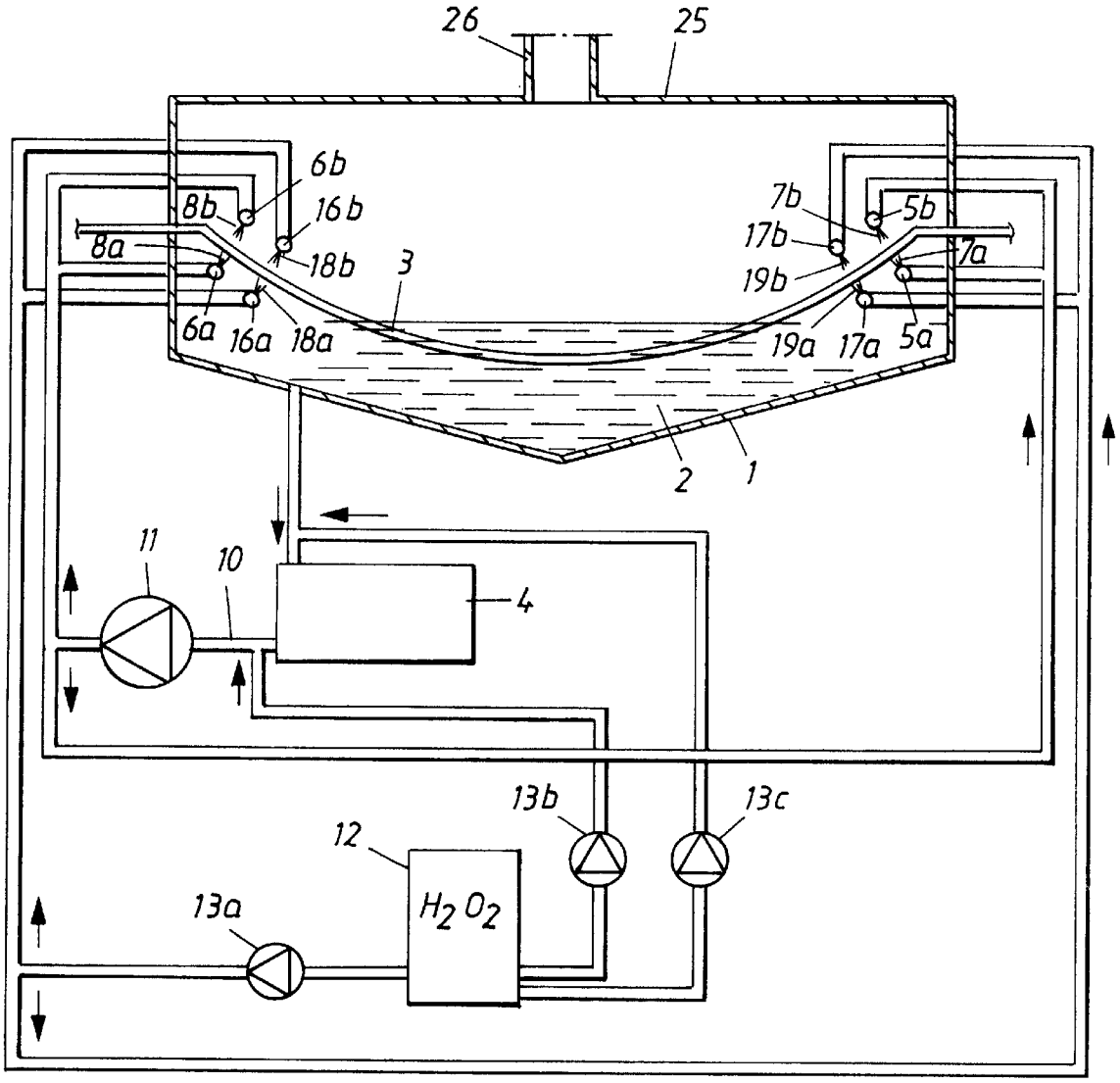
26
25
6b
8b
16b
8a
18b
3
7b
5b
17b
7a
19b
6a
16a
18a
19a
17a
5a
2
1
11
10
4
13b
13c
12
$H_2O_2$
13a

METHOD OF TREATING A METAL

This application claims benefit of provisional application No. 60/052,734, filed Jul. 08, 1997.

The present invention relates to a method of pickling or surface treating a metal in a solution containing nitric acid to which hydrogen peroxide is supplied to decrease the formation of nitrous fumes.

At manufacturing of many metals such as steel, particularly stainless steel, an oxide layer forms at the surface during the annealing, and this layer must be removed. This is normally done by pickling which means that the steel is treated in an acidic oxidising pickling bath to affect some dissolution of metal under the oxide layer which then comes loose. Pickling and surface treatment of metals is often performed in a solution based on nitric acid as an oxidising agent which treatment, however, involves emissions of nitrous fumes, mainly NO and $NO_2$. These emissions can be reduced significantly by adding hydrogen peroxide to the nitric acid containing solution as disclosed in the U.S. Pat. Nos. 4,938,838 and 3,945,865 as well as in H. T. Karlsson et al, "Control of $NO_x$ in Steel Pickling", Environmental Progress, Vol. 3, No. 1, 1984, pp. 40–43. In pickling of steel the following reactions occur:

$$2Fe+6H^+ +3NO_3^- \leftrightarrows 2Fe^{3+}+3NO_2^- +3H_2O$$

$$2NO_2^- +2H^+ \leftrightarrows NO+NO_2+H_2O$$

$$NO_2^- +H_2O_2 \leftrightarrows NO_3^- +H_2O$$

This process generally works very well, but it has been found that in order to decrease the emissions below a certain level far more than stochiometric amounts of hydrogen peroxide must be supplied. At the same time, increasing consciousness of environmental problems call for more effective reduction of nitrous fumes.

The present invention intends to solve the problem of further reducing the emissions of nitrous fumes or $NO_x$, particularly NO and $NO_2$, without increasing the hydrogen peroxide consumption to unacceptable levels. According to the invention it has surprisingly been found that the reduction of $NO_x$ emissions can be improved considerably without significantly increasing the hydrogen peroxide consumption if at least a part of the hydrogen peroxide is sprayed or flushed directly on the metal instead of being added to the nitric acid containing solution, either directly into a tub in which the metal is treated or into a circulation conduit for the nitric acid containing solution.

Thus, the present invention concerns a method of pickling or surface treating a metal in an aqueous solution containing nitric acid wherein hydrogen peroxide is supplied to decrease the formation of nitrous fumes. At least a portion of the hydrogen peroxide is supplied by spraying or flushing an aqueous solution thereof directly on the metal through one or several separate nozzles. Preferably the hydrogen peroxide is sprayed in a way to obtain as small droplets as possible which makes the reaction with the $NO_x$, more efficient. Although it is possible to supply substantially all the hydrogen peroxide through the separate nozzles, the preferred portion is from about 20 to about 80%, most preferably from about 40 to about 60% of the total amount of hydrogen peroxide supplied.

Without being bound to any theory it is assumed that hydrogen peroxide coming into contact with metal ions in a pickling solution decomposes catalytically into water and oxygen and is thus consumed to no use. It is also assumed that the main part of the nitrous fumes are generated at the surface of the metal and that the hydrogen peroxide therefore is most likely to contact the $NO_x$ before it comes into contact with metal ions if it is sprayed or flushed directly on the metal. This is supposed to be particularly true when nitric acid containing solution is sprayed or flushed directly on the metal in which processes considerable amounts of nitrous fumes evolve even at very low concentrations of dissolved $NO_x$.

The nitric acid solution normally contains from about 0.1 to about 4 mols/l, preferably from about 0.5 to about 3 mols/l of nitric acid, and suitable also hydrofluoric acid, for example from about 0.01 to about 5 mols/l, preferably from about 0.1 to about 3 mols/l. The content of dissolved $NO_x$ is normally from about 0.01 to about 0.7 g/l, preferably from about 0.1 to about 0.4 g/l. The invention is particularly advantageous when the content of dissolved $NO_x$, is below about 0.7 g/l. Normally most of the dissolved $NO_x$ is in the form of $NO_2^-$.

According to the invention it is generally possible to maintain the emissions of $NO_x$ gas below about 7 g $NO_x$ per $m^2$ treated metal and often even below about 4 $NO_x$ per $m^2$ treated metal at a hydrogen peroxide consumption from about 2 to about 60 g $H_2O_2$, preferably from about 5 to about 40 g $H_2O_2$ per $m^2$ treated metal.

The amount of hydrogen peroxide added can be controlled by conventional method such a by measuring the redox potential in the nitric acid containing solution or measuring the content of $NO_x$ in the exhaust gas. Preferred redox potential control methods are described in U.S. Pat. No. 4,938,838 and EP 442250.

The invention is advantageous in all processes for surface treatments of metals such as steel, copper or brass with nitric acid containing solutions. It is particularly advantageous in pickling of steel, especially stainless steel.

The invention will now be described in connection with the enclosed Figure schematically showing an embodiment of a process of treating a metal.

The figure shows a tub 1 containing a surface treating or pickling bath 2 of an aqueous solution containing nitric acid and preferably also hydrofluoric acid through which a running strip 3 of a metal, preferably stainless steel, is conducted continuously. Nitric acid containing solution is supplied through lances 5*a*, 5*b*, 6*a*, 6*b*, each containing a plurality of nozzles 7*a*, 7*b*, 8*a*, 8*b* spraying the solution on each side of the metal strip 3 so it is distributed over substantially the entire width thereof. Solution from the bath 2 is withdrawn to a tank 4 and is fed to the lances 5*a*, 5*b*, 6*a*, 6*b* at sufficiently high pressure via a circulation conduit 10 and a pump 11. The process also involves supply of an aqueous solution of hydrogen peroxide from at storage tank 12. A portion of the hydrogen peroxide is brought by a pump 13*a* to separate lances 16*a*, 16*b*, 17*a*, 17*b*, each containing a plurality of nozzles 18*a*, 18*b*, 19*a*, 19*b* spraying the solution on each side of the metal strip 3 so it is distributed over substantially the entire width thereof. The suitable number of nozzles depends on the size of the metal strip 3 and on the type of nozzles, but normally from about 4 to about 12 nozzles per lance is sufficient. Any conventional nozzle can be used, for example nozzles also blowing air which prevents clogging at interruption of the hydrogen peroxide flow. The remaining part of the hydrogen peroxide supplied is added by pumps 13*b*, 13*c* to the nitric acid containing solution in the tank 4 and the circulation conduit 10 at the suction side of the pump 11. The hydrogen peroxide from the pump 13*c* is preferably mixed with the solution from the bath 2 just before it enters the tank 4. Above the tub 1 a hood 25 containing a vent 26 is arranged. Any nitrous fumes formed is evacuated through the vent 26. The supply of hydrogen peroxide is preferably controlled on basis of the $NO_x$, content in the gas stream in the vent 26 or of the redox potential in the bath 2. It is also possible to have fixed flow of hydrogen peroxide added through the nozzles 18*a*, 18*b*, 19*a*, 19*b* a supplying hydrogen peroxide to the tank 4 and the circulation conduit 10.

Although not shown in the FIG. it is possible to treat the metal strip 3 without immersing it into the bath 2. It is also possible to convey the metal strip 3 vertically and spray the nitric acid containing solution and the hydrogen peroxide on the vertical surfaces.

The invention is further illustrated through the following example. If not otherwise stated all contents and percentages refer to wt %.

EXAMPLE:

In a plant according to the Figure stainless steel was pickled in a an aqueous solution of 2.9 mols/l nitric acid and 2.7 mols/l hydrofluoric acid. When all the hydrogen peroxide was added to the nitric acid containing solution in the tank 4 and the circulation conduit a hydrogen peroxide consumption of 60–70 ml 35% aqueous $H_2O_2$ per $m^2$ pickled steel was required to keep a $NO_x$ concentration below 280 ppm in the vent 26 (corresponding to 3.5 g $NO_x$ per $m^2$ pickled steel). When the process was operated according to the invention and about 45% of the hydrogen peroxide supplied was sprayed directly on the steel surface through the separate lances 16*b*, 17*b* above the steel strip 3, each containing six nozzles 18*b*, 19*b*, the consumption required to keep a $NO_x$ concentration below 280 ppm in the vent 26 was only 40–45 ml 35% aqueous $H_2O_2$ per $m^2$ pickled steel.

We claim:

1. A method of pickling or surface treating a metal, comprising the steps of (a) placing a metal in an aqueous solution containing nitric acid; and (b) supplying hydrogen peroxide to the aqueous solution in an amount sufficient to decrease the formation of nitrous fumes;

wherein at least a portion of the hydrogen peroxide is supplied by spraying or flushing an aqueous solution thereof directly on said metal through one or more separate nozzles.

2. A method as claimed in claim 1, wherein in that from about 20 to about 80% of the total amount of hydrogen peroxide supplied is supplied through the separate nozzles (18*a*, 18*b*, 19*a*, 19*b*).

3. A method as claimed in claim 2, wherein from about 40 to about 60% of the total amount of hydrogen peroxide supplied is supplied through the separate nozzles (18*a*, 18*b*, 19*a*, 19*b*).

4. A method as claimed in any one of the claim 1, wherein from about 2 to about 60 g $H_2O_2$ per $m^2$ treated metal is supplied.

5. A method as claimed in any one of the claim 1, wherein nitric acid containing solution is sprayed directly on the metal.

6. A method as claimed in any one of the claim 1, wherein the nitric acid solution contains from about 0.1 to about 4 mols.

7. A method as claimed in any one of the claim 1, wherein the content of dissolved $NO_x$, in the nitric acid containing solution is below about 0.7 g/L.

8. A method as claimed in any one of the claims 1, wherein the metal is steel.

9. A method as claimed in any one of the claim 1, wherein the emissions of $NO_x$, is maintained below about 7 g per $m^2$ pickled metal.

10. A method as claimed in any one of the claim 1, wherein in the nitric acid containing solution also contains hydrofluoric acid.

* * * * *